US010309170B2

(12) United States Patent
Bourgeois et al.

(10) Patent No.: US 10,309,170 B2
(45) Date of Patent: Jun. 4, 2019

(54) SPINNER TOOL WITH CONTROL VALVE

(71) Applicant: FORUM US, INC., Houston, TX (US)

(72) Inventors: Joshua Kyle Bourgeois, Broussard, LA (US); Andre Vierke, Hamburg (DE); Lawrence E. Childress, II, Lafayette, LA (US)

(73) Assignee: FORUM US, INC., Houston, TX (US)

( * ) Notice: Subject to any disclaimer, the term of this patent is extended or adjusted under 35 U.S.C. 154(b) by 356 days.

(21) Appl. No.: 15/172,881

(22) Filed: Jun. 3, 2016

(65) Prior Publication Data

US 2017/0350200 A1 Dec. 7, 2017

(51) Int. Cl.
*E21B 19/16* (2006.01)
*E21B 17/042* (2006.01)

(52) U.S. Cl.
CPC ..... *E21B 19/168* (2013.01); *E21B 17/042* (2013.01); *E21B 19/165* (2013.01)

(58) Field of Classification Search
CPC ..... B23P 19/061; E21B 19/163; E21B 19/16; E21B 19/164; E21B 19/161; E21B 19/168; E21B 17/042; E21B 19/165; B25B 13/54
See application file for complete search history.

(56) References Cited

U.S. PATENT DOCUMENTS

| | | | | |
|---|---|---|---|---|
| 4,305,472 | A | 12/1981 | Brossette | |
| 4,567,779 | A | 2/1986 | Byrne | |
| 4,579,024 | A | 4/1986 | Coyle, Sr. | |
| 4,700,787 | A * | 10/1987 | Buck | E21B 19/166 173/164 |
| 5,245,265 | A | 9/1993 | Clay | |
| 7,191,686 | B1 * | 3/2007 | Angelle | E21B 19/163 81/57.16 |
| 7,891,418 | B2 | 2/2011 | Begnaud et al. | |

OTHER PUBLICATIONS

International Search Report and Written Opinion dated Jul. 19, 2017, corresponding to Application No. PCT/US2017/029656.

* cited by examiner

*Primary Examiner* — Robert J Scruggs
(74) *Attorney, Agent, or Firm* — Patterson + Sheridan, LLP

(57) ABSTRACT

A tubular rotating system for rotating threaded tubulars is provided. The system includes a frame, a plurality of rollers coupled to the frame and configured to rotate a tubular, and a control valve coupled to the frame and configured to control a rotational speed of the rollers. The control valve controls an amount of air, fluid, or electric power supplied to the system based on tension applied to the system to thereby control the speed at which the rollers rotate.

20 Claims, 4 Drawing Sheets

SPINNER TOOL WITH CONTROL VALVE

BACKGROUND

Field

Embodiments disclosed herein relate to a spinner system for coupling or de-coupling tubulars in a drilling or work-over operation utilized in the oil and gas industry. More specifically, embodiments disclosed herein relate to a control valve that controls the fluid flow and accordingly the torque and speed at which a spinner tool can operate if the spinner tool is not secured by a safety snub line.

Description of the Related Art

A spinner tool (also known as a "pipe spinner") is commonly used in the oil and gas industry. The spinner tool is an air or hydraulically powered tool used to spin tubular pipe in making up or breaking out threaded connections. The spinner tool may be used to thread tubulars together in a drilling operation (make-up) or used to de-couple tubulars by rotating the tubular in an opposite direction. The spinner tool is a relatively low torque device, useful for the initial makeup of threaded tool joints in a drilling operation, and a separate power tong is subsequently used to provide proper torque to complete threaded connections.

During operation on a rig, the spinner tool is suspended above a rotary spider that is located in the rig floor. The spinner tool has rollers that are moved into position about a pin end of a tubular and configured to rotate the tubular relative to another tubular (held by the rotary spider) to threadedly couple the two tubulars together. The rollers are coupled to a frame of the spinner tool that needs to be fixed to prevent inadvertent rotation of the frame about the tubulars. A snub line in the form of a cable or wire rope is typically utilized to secure the frame to a winch or other fixed object to prevent the frame from rotating. However, personnel sometimes forget to attach the snub line which may allow the frame to rotate when the spinner tool is operated and potentially injury nearby personnel and/or damage surrounding equipment. This creates a safety hazard on the rig.

Therefore, there exists a need for a new and improved spinner tool that prevents the safety hazard described above.

SUMMARY

In one embodiment, a tubular rotating system for rotating threaded tubulars comprises a frame; a plurality of rollers coupled to the frame and configured to rotate a tubular; and a control valve coupled to the frame that controls rotational speed of the rollers based on a tension force.

In one embodiment, a tubular rotating system for rotating threaded tubulars comprises a frame; a plurality of rollers coupled to the frame and configured to rotate a tubular; and a control valve coupled to the frame and configured to control power supplied to the rollers, wherein the rollers are rotated at a first rotational speed greater than zero when the control valve is in an off state, and at a second rotational speed greater than the first rotational speed when the control valve is in an on state.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the disclosure include a tubular rotating system for use in the oil and gas industry. The system includes a spinner tool and a control valve attached to the spinner tool. The control valve controls the power utilized by the spinner tool based on tension as further described below. The power may be fluid power (such as liquid or air) or electric power. While the embodiments of the disclosure are described with respect to a spinner system and spinner tool, the embodiments of the disclosure are not limited to only spinner systems and spinner tools, but may include other similar tubular rotating systems and tools that may be coupled to a fixed object by a snub line during operation, such as an iron roughneck system.

Figure 1:
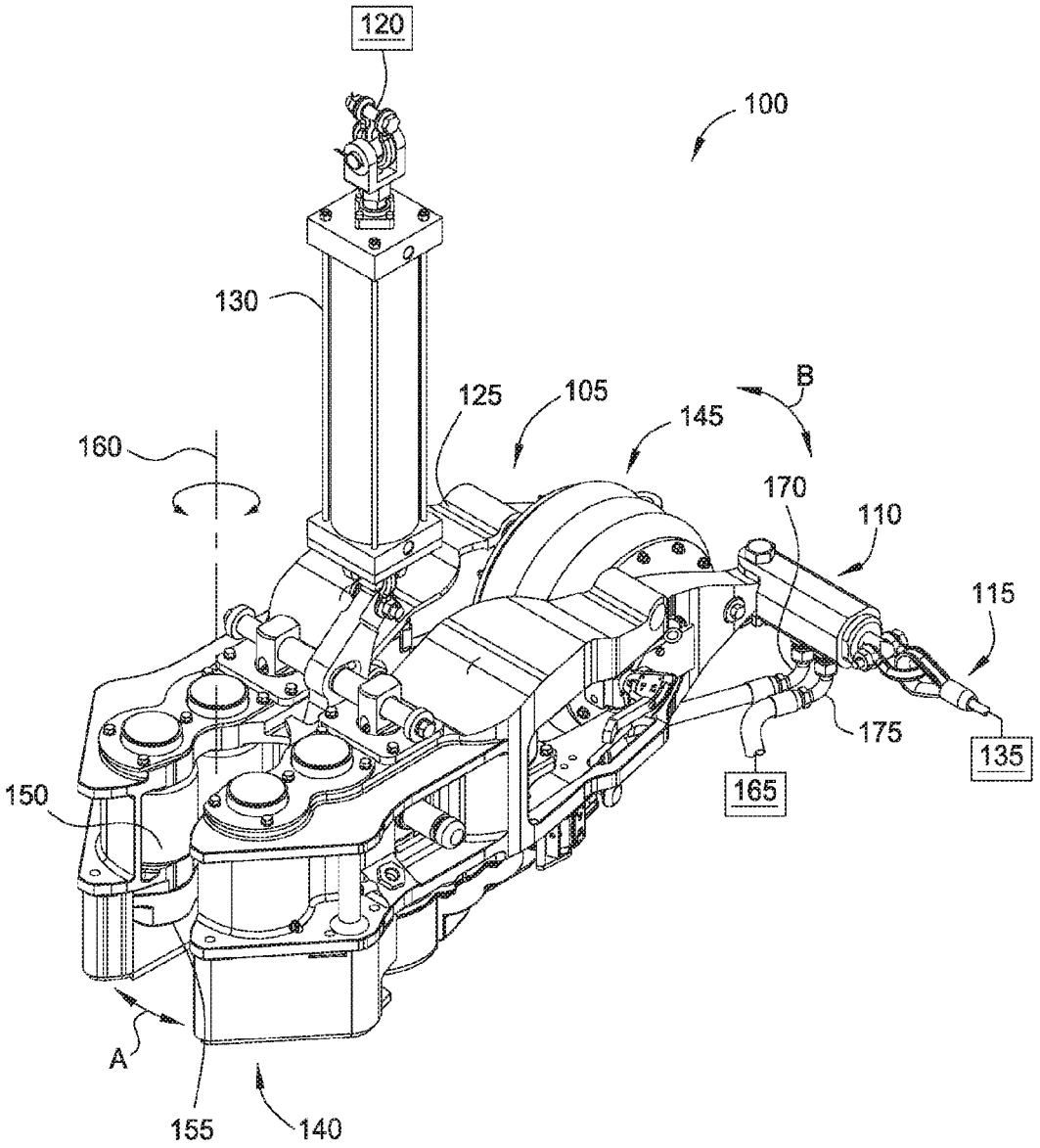
FIG. 1 is an isometric view of one embodiment of a spinner system.

FIG. 1 is an isometric view of one embodiment of a spinner system 100. The system 100 includes a spinner tool 105, a control valve 110 coupled to the spinner tool 105, and a snub line 115 coupled to the control valve 110. The spinner tool 105 may be suspended from a crane structure 120 to position a frame 125 of the spinner tool 105 above a rotary spider located in a rig floor (not shown). In one embodiment, a vertical actuator, such as a cylinder 130, may be coupled between the crane structure 120 and the frame 125.

The control valve 110 is coupled to the frame 125 and the snub line 115 may be coupled to a fixed object 135, such as a portion of the rig or a winch. The spinner tool 105 includes a jaw assembly 140 that is pivotably coupled to the frame 125, and an actuator assembly 145 that controls opening and closing of the jaw assembly 140 about a tubular in the direction of the arrow A. The jaw assembly 140 includes one or more rollers 150 that are movable into contact with an outer surface of a tubular when the jaw assembly 140 is closed. Each of the rollers 150 are operably coupled to a motor 155 that rotates the rollers 150 to rotate a tubular about an axis 160. The snub line 115, being coupled to the fixed object 135, prevents inadvertent rotation of the frame 125 about the axis 160 when the rollers 150 are rotating a tubular.

Personnel may forget to attach the snub line 115 to the spinner tool 105 and/or the fixed object 135, which may allow the frame 125 to rotate about the axis 160 in an uncontrolled manner. Alternatively, the snub line 115 may break or loosen during operation of the spinner tool 105, which may also permit the frame 125 to rotate about the axis 160 in an uncontrolled manner. Inadvertent rotation of the frame 125 may cause injury or death to personnel, and/or may also damage the spinner tool 105 and/or other surrounding equipment.

To prevent inadvertent rotation of the spinner tool 105, the control valve 110 is configured to control operation of the spinner tool 105 based on whether the snub line 115 is taut and/or attached to the fixed object 135. The control valve 110 controls the amount of operating fluid supplied to the spinner tool 105 based on the amount of tension in the snub line 115. If little or no tension is applied to the snub line 115, the control valve 110 restricts the amount of operating fluid supplied to the spinner tool 105 such that spinner tool 105 may only operate at a low speed. When sufficient tension is applied to the snub line 115, the control valve 110 permits the maximum amount of operating fluid to be supplied to the spinner tool 105 such that the spinner tool 105 may operate at a maximum speed.

The motors 155 may be hydraulically or pneumatically powered by an operating fluid supplied from a power source 165. The power source 165 is in fluid communication with the motors 155 by an outlet conduit 170 that is coupled to the control valve 110, and an inlet conduit 175 that is coupled to the power source 165 and the control valve 110. Operating fluid that actuates the motors 155, and in turn rotates the rollers 150, is pumped from the power source 165 to the control valve 110 via the inlet conduit 175, and from the control valve 110 to the motors 155 via the outlet conduit 170. While the outlet conduit 170 and the inlet conduit 175 are described in this embodiment as transferring fluids, in other embodiments, the outlet conduit 170 and the inlet conduit 175 may be utilized to transfer electric power as described with respect to FIG. 3 below.

When the control valve 110 is in an off state, such as a first position, the control valve 110 permits only a portion of the operating fluid (i.e., a first or low pressure and/or volume of fluid) to pass through the control valve 110 and to the motors 155 via the outlet conduit 170, which rotates the rollers 150 at a first speed, such as a minimum or low speed that is greater than zero. In one example, during a make-up operation, the rollers 150 may be rotating in a counterclockwise direction to rotate a tubular about the axis 160 in a clockwise direction.

The frame 125 may want to rotate in the direction of arrow B when the rollers 150 are actuated to rotate a tubular and thereby pull on the snub line 115. When the snub line 115 becomes taut and/or is tension by being attached to the fixed object 135 (such as by rotation of the frame 125 and/or tensioning of the snub line 115 by the fixed object 135, e.g. a winch), the control valve 110 is actuated to an on state, such as a second position, that permits additional operating fluid (i.e., a second or high pressure and/or volume of fluid) to be supplied to the motors 155. The additional operating fluid may actuate the rollers 150 to rotate at a second speed, such as a maximum or high speed, to rotate a tubular at a greater rotational speed as compared to the rotational speed when the control valve 110 is in the first position and restricts the operating fluid such that only a portion of operating fluid is supplied to the motors 155.

If the snub line 115 becomes loose and is not taut and/or tensioned, the control valve 110 remains in the first position and the rollers 150 are limited in rotational speed based on the first or low pressure and/or volume of fluid. The slower rotational speed of the rollers 150, provided when the control valve 110 is in the first position, allows personnel to react by moving out of the rotational path of the frame 125 and/or disable the operating fluid flow from the power source 165 to cease operation of the spinner tool 105. Thereafter, the snub line 115 may be attached (or re-attached) to the fixed object 135 and the operating fluid flow from the power source 165 may resume, which may again cause slight rotation of the frame 125 in the direction of arrow B as described above. When the snub line 115 is taut and/or tensioned, the control valve 110 is actuated back to the second position to provide the second or high pressure and/or volume of fluid, which allows the rollers 150 to operate at a higher rotational speed.

Figure 2A:
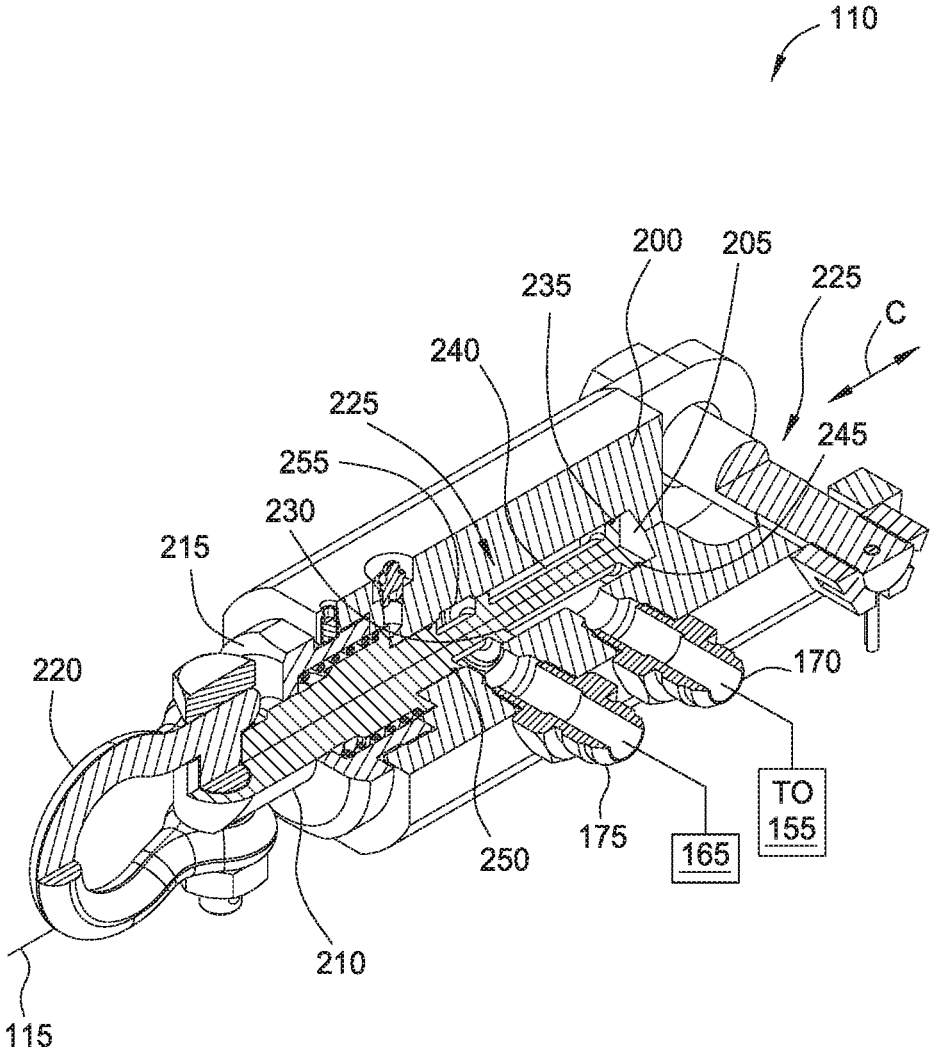
FIGS. 2A and 2B are isometric views of a control valve of the spinner system shown in partial cross-section.
Figure 2B:
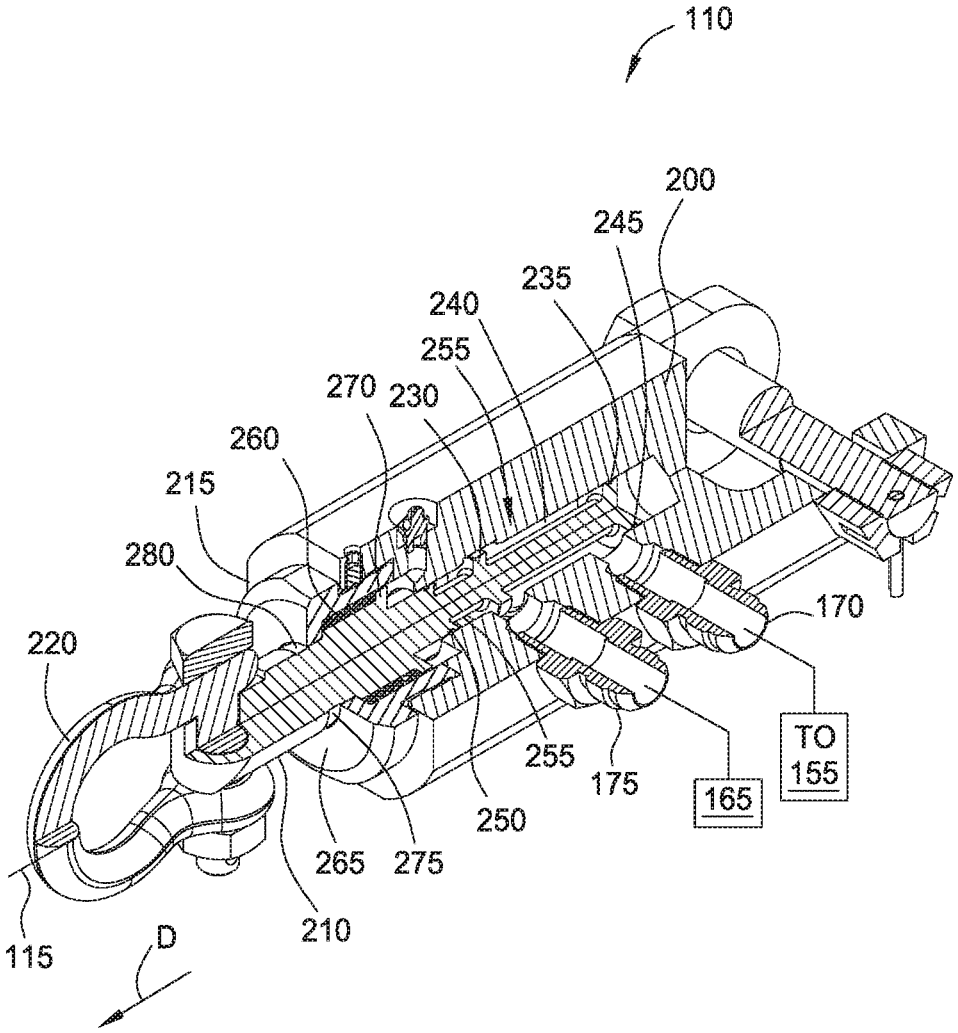

FIGS. 2A and 2B are isometric views of the control valve 110 in cross-section. FIG. 2A shows the control valve 110 in the first position, while FIG. 2B shows the control valve 110 in the second position.

The control valve 110 includes a body 200 having a central bore 205 formed therein. The outlet conduit 170 and the inlet conduit 175 are at least partially formed in and/or coupled to the body 200 to be in fluid communication with the central bore 205. A piston 210 is retained within the body 200 by a nut 215 that may be threadedly attached to a first end of the body 200. The piston 210 is movable within the central bore 205 in the direction of arrow C. A proximal end of the piston 210 is extends out of a first end of the body 200 and may be coupled to the snub line 115 by a coupler 220, such as an eyelet or shackle. A second end of the body 200 may include a coupling mechanism 225 for attachment to the frame 125 of the spinner tool 105.

The piston 210 includes a valve body 225 having a valve 230 and a containment ring 235. The valve body 225 includes an elongated first volume 240 formed between a reduced inner diameter portion of the central bore 205, and a reduced outer diameter portion of the piston 210 between the valve 230 and the containment ring 235. A seal 245, such as an O-ring, may be disposed on the containment ring 235 to prevent fluid flow outside of the first volume 240. Operating fluid may flow around the valve 230 and/or between the valve 230 and the reduced inner diameter portion of the central bore 205. Operating fluid may be contained in the body 200 by a seal 250 disposed on the piston 210 adjacent to a second volume 255 formed by an enlarged inner diameter portion of the central bore 205 that is next to the reduced inner diameter portion of the central bore 205.

In the first position as shown in FIG. 2A, a tension provided by the snub line 115 is less than a certain threshold tension, or has no tension at all (indicative of an un-attached or broken snub line 115), operating fluid flows from the power source 165 to the inlet conduit 175 and to the second volume 255 at a first pressure. A portion of the operating fluid and/or fluid pressure flows pass the valve 230 into the first volume 240 and to the motors 155 through the outlet conduit 170. In one example, the first pressure of the operating fluid provided by the power source 165 may be about 200 pounds per square inch (psi). This first pressure may remain constant.

In the first position, a percentage of the first pressure may pass the valve 230 (i.e., a second pressure), enter the volume 240, and flow to the motors 155 through the outlet conduit 170. For example, when the inlet pressure is 100%, a percentage of the inlet pressure less than the inlet pressure is flowed to the motors 155. At 100% inlet pressure, the outlet pressure may be about 10% to about 15%, such as about 12%. The reduction of pressure may be determined based on a size of a gap or gaps between the valve 230 and the central bore 205.

In the example using an inlet pressure of about 200 psi, the outlet pressure may be about 24 psi. Thus, the motors 155 are operated at a reduced pressure when the control valve 110 is in the first position, which causes the rollers 150 to rotate at a rotational speed that is less than a full rotational speed when the control valve 110 is in the second position and 100% pressure is provided thereto. In one embodiment, the full rotational speed of the rollers 150 may be about 140 revolutions per minute (rpm) to about 210 rpm. According to one example, if the full rotational speed of each of the rollers is about 150 rpm, then the reduced speed provided when the control valve 110 is in the first position would be between about 14 rpm to about 21 rpm. Therefore, any rotational movement of the spinner tool 105, if not secured by the snub line 115, is slowed, which allows personnel to react to the non-tensioned snub line 115 without injury or damage.

When the snub line 115 is secured, and a predetermined tension is applied to the control valve 110, the control valve 110 is moved to the second position as shown in FIG. 2B. The predetermined tension may be provided to overcome a force of a biasing member 260, such as a spring, provided in a cavity between a plate 265 of the nut 215 and a radially extending shoulder 270 of the piston 210 that forces the control valve 110 into the first position. In one embodiment, the predetermined tension may be about 25 pounds.

Once the tension overcomes and compresses the biasing member 260, the piston 210 moves relative to the body 200 in the direction of arrow D. The movement displaces the position of the valve 230 relative to the inlet conduit 175 such that the valve 230 is positioned in the second volume 255. Thus, the inlet conduit 175 is in full fluid communication with the outlet conduit 170 via the volume 240 so that all of the operating fluid flow is allowed to flow through, and fluid pressure delivered at the inlet conduit 175 is flowed out of the outlet conduit 170 to the motors 155 at the same pressure as the inlet pressure. This provides fluids to the motors 155 at a pressure and volume for maximum rotational speeds.

In one embodiment, the piston 210 includes a region 275 that serves as a visual indicator confirming that the control valve 110 is tensioned. The region 275 may be a depressed annular region of the piston 210 (i.e., a reduced diameter region of the piston 210). Alternatively or additionally, the region 275 may include a color 280 that is different than a color of the piston 210. The color 280 may be a high-visibility paint or coating, such as orange or red, which is easily recognizable.

Figure 3:
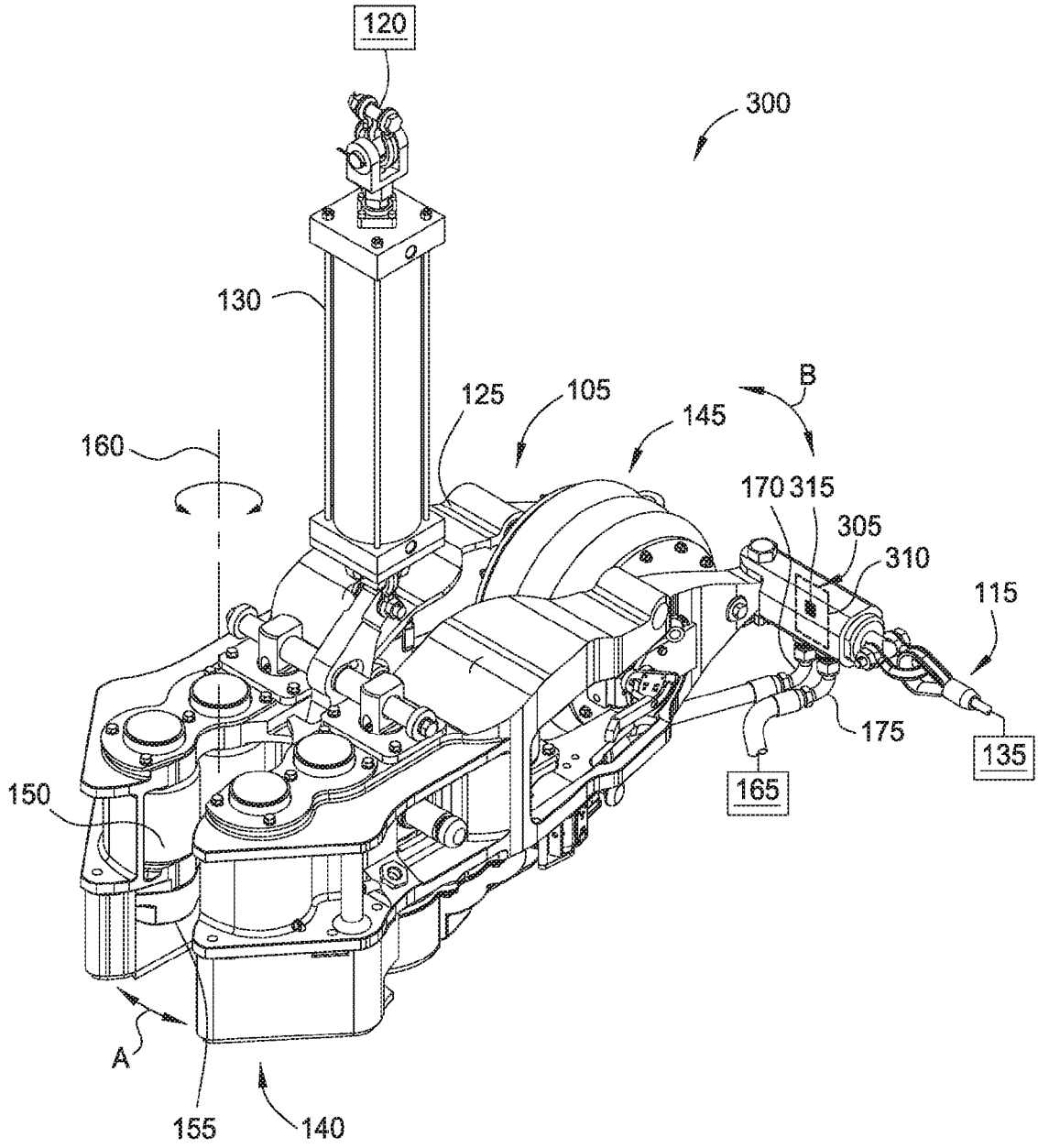
FIG. 3 is an isometric view of one embodiment of a spinner system.

FIG. 3 is an isometric view of one embodiment of a spinner system 300. A control valve 305 is shown coupled between the frame 125 and the snub line 115. The control valve 305 is similar to the control valve 110 shown and described in FIGS. 1, 2A, and 2B with the following exceptions.

The motors 155 are electrically powered motors, and the control valve 305 controls the amount of electric power supplied to the motors 155 based on tension applied to the control valve 305. The control valve 305 may control the current (amperage) and/or the voltage of the electric power supplied to the motors 155 via the inlet and outlet conduits 175, 170. The control valve 305 according to this embodiment includes an electric actuator 310. The electric actuator 310 may be a strain gauge or a proximity sensor that utilizes a contactor 315 to control an amount of electric power supplied to the motors 155 when a specified tensioned is applied between the frame 125 and the snub line 115.

For example, when a specified tension is applied to the control valve 305, the contactor 315 provides a circuit that controls electrical power to the motors 155 in an amount for maximum rotational speeds of the rollers 150. For another example, when little or no tension is applied to the control valve 305, the contactor 315 provides a circuit that controls electrical power to the motors 155 in an amount for less than maximum rotational speeds of the rollers 150.

When the control valve 305 is at a first position (e.g. with little or no tension), a first amount of electric power may be provided to the motors 155. When the control valve 305 is at a second position (e.g. when tensioned), a second amount of electric power greater than the first amount of electric power may be provided to the motors 155.

When the control valve 305 is in the first position, electric power from the power source 165 is restricted such that only a portion of the electric power is supplied to the motors 155. When the snub line 115 becomes taut and/or is tensioned by being attached to the fixed object 135 (such as by rotation of the frame 125 and/or tensioning of the snub line 115 by the fixed object 135, (e.g. a winch), the control valve 305 is actuated to an on state, such as the second position, that permits a greater portion or all of the electric power from the power source 165 to be supplied to the motors 155. The amount of electric power supplied to the motors 155 when the control valve 305 is in the second position may actuate the rollers 150 to rotate at a second speed, such as a maximum or high speed, to rotate a tubular at a greater rotational speed as compared to the rotational speed when the control valve 305 is in the first position and where the electric power from the power source 165 is restricted such that only a portion of the electric power is supplied to the motors 155.

If the snub line 115 becomes loose and is not taut and/or tensioned, the control valve 305 remains in the first position and the rollers 150 are limited in rotational speed based on the first or lower amount of electrical power supplied to the motors 155. The slower rotational speed of the rollers 150, provided when the control valve 305 is in the first position, allows personnel to react by moving out of the rotational path of the frame 125 and/or disable the electric power from the power source 165 to cease operation of the spinner tool 105. Thereafter, the snub line 115 may be attached (or re-attached) to the fixed object 135 and the higher amount of electric power from the power source 165 may resume, which may again cause slight rotation of the frame 125 in the direction of arrow B as described above. When the snub line 115 is taut and/or tensioned, the control valve 305 is actuated back to the second position to provide the second or higher power from the power source 165, which allows the rollers 150 to operate at a higher rotational speed.

While the foregoing is directed to embodiments of the disclosure, other and further embodiments of the disclosure thus may be devised without departing from the basic scope thereof, and the scope thereof is determined by the claims that follow.

The invention claimed is:

1. A tubular rotating system for rotating threaded tubulars, the system comprising:

a frame;

a plurality of rollers coupled to the frame and configured to rotate a tubular; and a control valve coupled to the frame and configured to control rotational speed of the rollers based on a tension force such that the rotational speed of the rollers increases as the tension force increases.

2. The system of claim 1, wherein the rotational speed is greater than zero when the control valve is in an off state.

3. The system of claim 2, wherein the rotational speed is about 10% to about 15% less than a maximum rotational speed of the rollers.

4. The system of claim 1, wherein the control valve comprises a piston having a valve disposed in a body.

5. The system of claim 4, wherein the valve is configured to allow only a portion of operating fluid flow through the body when the control valve is in an off state.

6. The system of claim 4, wherein the control valve further comprises a biasing member disposed in the body that applies a force to the piston.

7. The system of claim 6, wherein the piston moves from a first position where the valve allows only a portion of operating fluid flow through the body to a second position where the valve allows all of the operating fluid flow through the body when the biasing member is compressed by the tension force.

8. The system of claim 7, wherein the rollers are rotated at a first rotational speed when the piston is in the first position, and wherein the rollers are rotated at a second rotational speed when the piston is in the second position, wherein the first rotational speed is less than the second rotational speed.

9. The system of claim 1, wherein the control valve comprises an electric actuator configured to control an amount of electric power supplied to rotate the rollers.

10. A tubular rotating system for rotating threaded tubulars, the system comprising:

a frame;

a plurality of rollers coupled to the frame and configured to rotate a tubular; and a control valve coupled to the frame and configured to control power supplied to the rollers, wherein the rollers are rotated at a first rotational speed greater than zero when the control valve is in an off state, and at a second rotational speed greater than the first rotational speed when the control valve is in an on state.

11. The system of claim 10, wherein the control valve comprises a piston having a valve disposed in a body.

12. The system of claim 11, wherein the valve is configured to allow only a portion of power through the body when the control valve is in the off state.

13. The system of claim 11, wherein the control valve further comprises a biasing member disposed in the body that applies a force to the piston.

14. The system of claim 13, wherein the piston moves from a first position where the valve allows only the portion of power through the body when the control valve is in the off state, to a second position where the valve allows all of the power through the body when the control valve is in the on state such that the biasing member is compressed.

15. The system of claim 11, wherein the rollers are rotated at the first rotational speed when no tension is applied to the piston, and wherein the rollers are rotated at the second rotational speed when tension is applied to the piston.

16. The system of claim 10, further comprising a snub line coupled to the control valve and configured to move the control valve from the off state to the on state when tension is applied to the snub line.

17. The system of claim 16, wherein when in the off state the control valve allows only a portion of the power to be supplied to the rollers, and wherein when in the on state the control valve allows full power to be supplied to the rollers.

18. The system of claim 10, wherein the control valve comprises an electric actuator configured to control the power supplied to rotate the rollers.

19. The system of claim 10, wherein the power is in the form of air, liquid, or electric power.

20. A tubular rotating system for rotating threaded tubulars, the system comprising:

a frame;

a plurality of rollers coupled to the frame and configured to rotate a tubular; and a control valve coupled to the frame and configured to control rotational speed of the rollers based on a tension force;

wherein the control valve comprises a piston having a valve disposed in a body and a biasing member disposed in the body that applies a force to the piston;

wherein the piston is configured to move from a first position where the valve allows only a portion of operating fluid flow through the body to a second position where the valve allows all of the operating fluid flow through the body when the biasing member is compressed by the tension force; and wherein the rollers are rotated at a first rotational speed when the piston is in the first position, the rollers are rotated at a second rotational speed when the piston is in the second position, and the first rotational speed is less than the second rotational speed.

* * * * *